US007147495B2

(12) United States Patent
Kuo

(10) Patent No.: US 7,147,495 B2
(45) Date of Patent: Dec. 12, 2006

(54) ELECTRICAL CARD CONNECTOR

(75) Inventor: Ming-Lun Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/347,129

(22) Filed: Feb. 3, 2006

(65) Prior Publication Data

US 2006/0148318 A1 Jul. 6, 2006

Related U.S. Application Data

(63) Continuation of application No. 11/028,051, filed on Dec. 31, 2004, now Pat. No. 7,090,513.

(51) Int. Cl.
*H01R 13/62* (2006.01)

(52) U.S. Cl. ..... 439/159

(58) Field of Classification Search ..... 439/159, 439/160

See application file for complete search history.

(56) References Cited

U.S. PATENT DOCUMENTS 5,871,365 A * 2/1999 Kajiura ..... 439/159
6,042,403 A * 3/2000 Nishioka ..... 439/159
6,059,589 A * 5/2000 Nishioka ..... 439/159
6,109,941 A * 8/2000 Koseki et al. ..... 439/159
6,113,403 A * 9/2000 Oguchi ..... 439/159
6,123,560 A * 9/2000 Hara et al. ..... 439/159
6,142,801 A * 11/2000 Koseki et al. ..... 439/159
6,162,075 A * 12/2000 Hara et al. ..... 439/159
6,234,813 B1 * 5/2001 Hanyu ..... 439/159
6,247,942 B1 * 6/2001 Furusho et al. ..... 439/108
6,482,020 B1 * 11/2002 Yeh ..... 439/159
6,527,568 B1 * 3/2003 Nakamura ..... 439/159
6,652,301 B1 * 11/2003 Harasawa et al. ..... 439/159
6,739,890 B1 * 5/2004 Hirata et al. ..... 439/159
6,796,816 B1 * 9/2004 He ..... 439/159
6,962,500 B1 * 11/2005 Chen ..... 439/159
6,986,675 B1 * 1/2006 Takada ..... 439/159
2002/0160639 A1 * 10/2002 Ezaki ..... 439/160
2003/0114031 A1 * 6/2003 Hu et al. ..... 439/159
2003/0124890 A1 * 7/2003 Harasawa et al. ..... 439/159
2004/0009691 A1 * 1/2004 Chang ..... 439/159
2004/0038570 A1 * 2/2004 He ..... 439/159
2004/0067668 A1 * 4/2004 Hirata et al. ..... 439/159
2004/0067669 A1 * 4/2004 Akasaka et al. ..... 439/159
2004/0087194 A1 * 5/2004 Wang et al. ..... 439/159
2004/0132326 A1 * 7/2004 Matsunaga et al. ..... 439/159
2004/0166713 A1 * 8/2004 Lai ..... 439/159
2004/0248445 A1 * 12/2004 Lai et al. ..... 439/159
2005/0142913 A1 * 6/2005 Cheng ..... 439/159
2005/0215098 A1 * 9/2005 Muramatsu et al. ..... 439/159
2005/0221649 A1 * 10/2005 Tanaka et al. ..... 439/159

(Continued)

*Primary Examiner*—Ross Gushi
(74) *Attorney, Agent, or Firm*—Wei Te Chung

(57) ABSTRACT

An electrical card connector (1) is provided for accommodating an electrical card. The electrical card connector comprises a dielectric housing having a plurality of connector terminals (20), a pair of soldering pieces (30), a shielding (40) assembled on the dielectric housing and defining an insertion port for insertion therein of the electrical card, and an ejector (70) for ejecting the electrical card received in the card connector. The soldering pieces are received respectively in slots of the dielectric housing and have legs for engaging with grounding pads of a printed circuit board. The shielding is formed with tabs (433, 443) extending to abut against the soldering pieces in the slots for establishing grounding pathes between the shielding and the printed circuit board.

20 Claims, 5 Drawing Sheets

U.S. PATENT DOCUMENTS

2005/0255730 A1* 11/2005 Oh ..... 439/160
2005/0272291 A1* 12/2005 Chang ..... 439/159
2005/0277319 A1* 12/2005 Kodera et al. ..... 439/159
2005/0287855 A1* 12/2005 Taguchi ..... 439/159
2006/0003617 A1* 1/2006 Motojima ..... 439/159
2006/0089032 A1* 4/2006 Chen ..... 439/159
2006/0089033 A1* 4/2006 Chen ..... 439/159
2006/0134954 A1* 6/2006 Xu et al. ..... 439/159
2006/0166531 A1* 7/2006 Tsai ..... 439/159
2006/0166532 A1* 7/2006 Tsai ..... 439/159

* cited by examiner

ELECTRICAL CARD CONNECTOR

CROSS-REFERENCE TO RELATED APPLICATION

This is a continuation application of a patent application Ser. No. 11/028,051, filed on Dec. 31, 2004 now U.S. Pat. No. 7,090,513.

BACKGROUND OF THE INVENTION

1. Field of the Invention

The present invention is generally related to an electrical card connector, and more particularly, to an electrical card connector having an improved shield device.

2. Description of Related Art

Most notebooks are provided with PC card connectors for accommodating PC cards as storage mediums. For adapting to the developments of the communication technology and electronic technology, the industry standard of the PC card need to update ceaselessly, according to the newest industry standard (Expresscard PC Card Standard), a PC card has a much quicker speed than conventional PC cards at data transmission, but thus enhancing the influence of the EMI and adversely affecting electrically performance of the electrical card connector.

In order to achieve a better electrical performance, a conventional electrical card connector is equipped with grounding devices to electrical connect with ground traces of a printed circuit board on which the connectors is mounted. Usually, such grounding devices may be a part extending from a shielding formed and stamped from a metallic plate or a pair of stand off devices assembling on sides of the shielding. However, since the extending part from the shielding usually is a thin metallic lath, it is easily to distort even break the extending part before the electrical card connector mounts on the printed circuit board, and the stand off devices for providing clearance between the connector and the printed circuit board are often far from the transfer interface, so it will influence the effect of anti-EMI.

U.S. Pat. No. 6,626,689 discloses an improved electrical card connector including an elongated dielectric housing having a plurality of connector terminals, a shielding covering the dielectric housing and a pair of stand off devices attaching to opposite sides of the shielding. A pair of screw holes are defined on opposite ends of the upper surface of the dielectric housing, a pair of bolts insert respectively into the screw holes to mount the electrical card connector on a printed circuit board, simultaneity, a tail portion of each bolts connects with a ground traces of the printed circuit board and the shielding abuts against the bolts at a edge thereof to establish a grounding path by the blots. However, these additional bolts will increase the difficulties of the assembly and the costs of the electrical card connector.

Hence, an electrical card connector is required to overcome the disadvantages of the related art.

SUMMARY OF THE INVENTION

Accordingly, an object of the present invention is to provide an electrical card connector having a pair of soldering pieces to solder with grounding pads on a printed circuit board, and a shielding electrical connecting with the soldering pieces to reduce EMI effect.

Another object of the present invention is to provide an electrical card connector which can retain a dielectric housing on a printed circuit board reliably.

To achieve the above objects, an electrical card connector in accordance with the present invention comprises a dielectric housing having a plurality of connector terminals and defining a pair of slots on opposite ends thereof, a pair of soldering pieces, a shielding assembling on the dielectric housing and defining an insertion port for insertion therein of an electrical card, and an ejector for ejecting the electrical card received in the card connector. Each soldering pieces is formed with a perpendicular wall received respectively in a slot of the dielectric housing and a leg extending from the base to fix on a grounding pad of a printed circuit board. The shielding is formed with tabs extending from sidewalls thereof to abut against the corresponding base of the soldering pieces received in the slots to establish a grounding path between the shielding and the printed circuit board.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
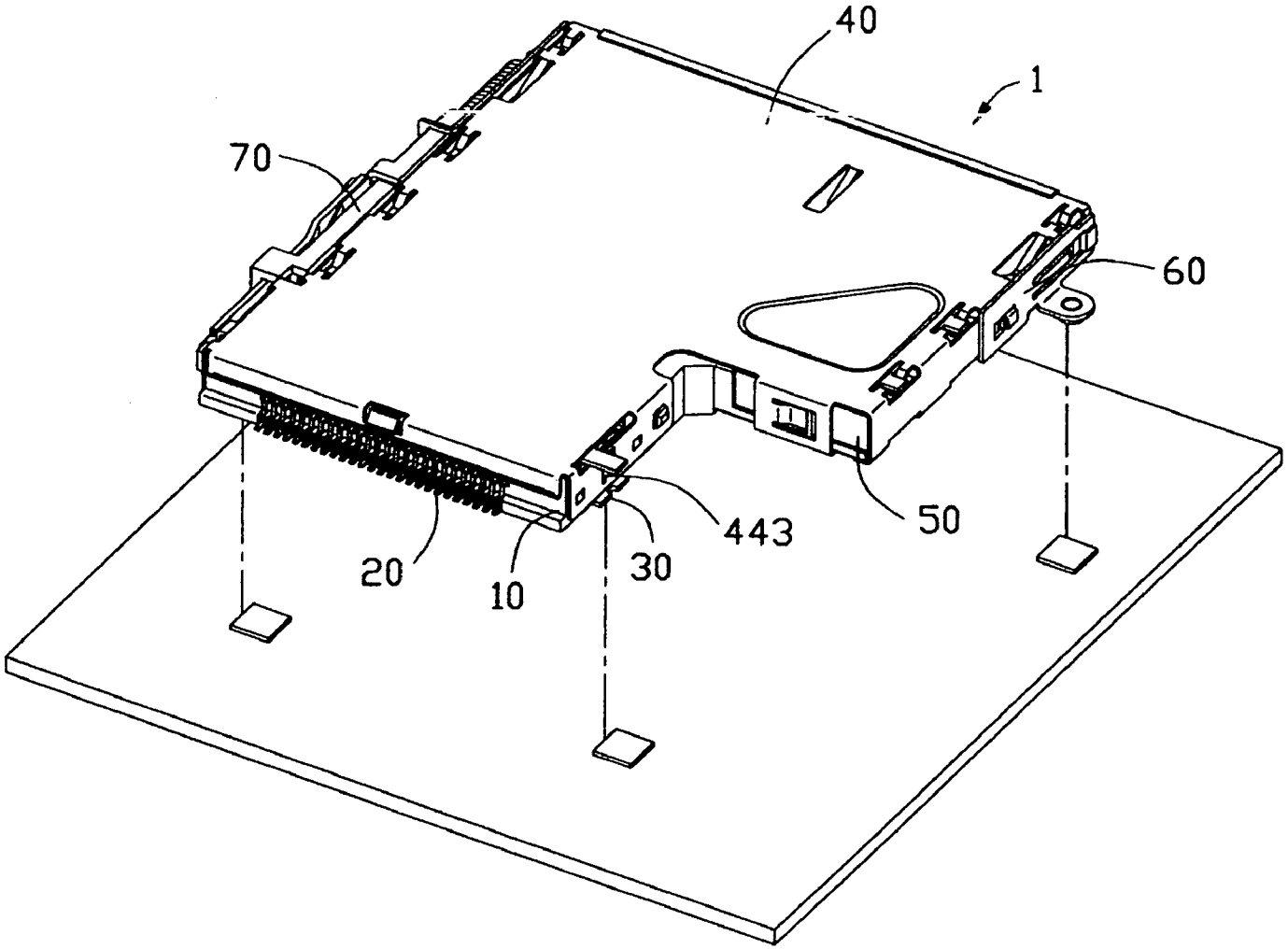
FIG. 1 is a perspective view of an electrical card connector in accordance with the present invention and a printed circuit board to which the electrical card connector is to be mounted.
Figure 2:
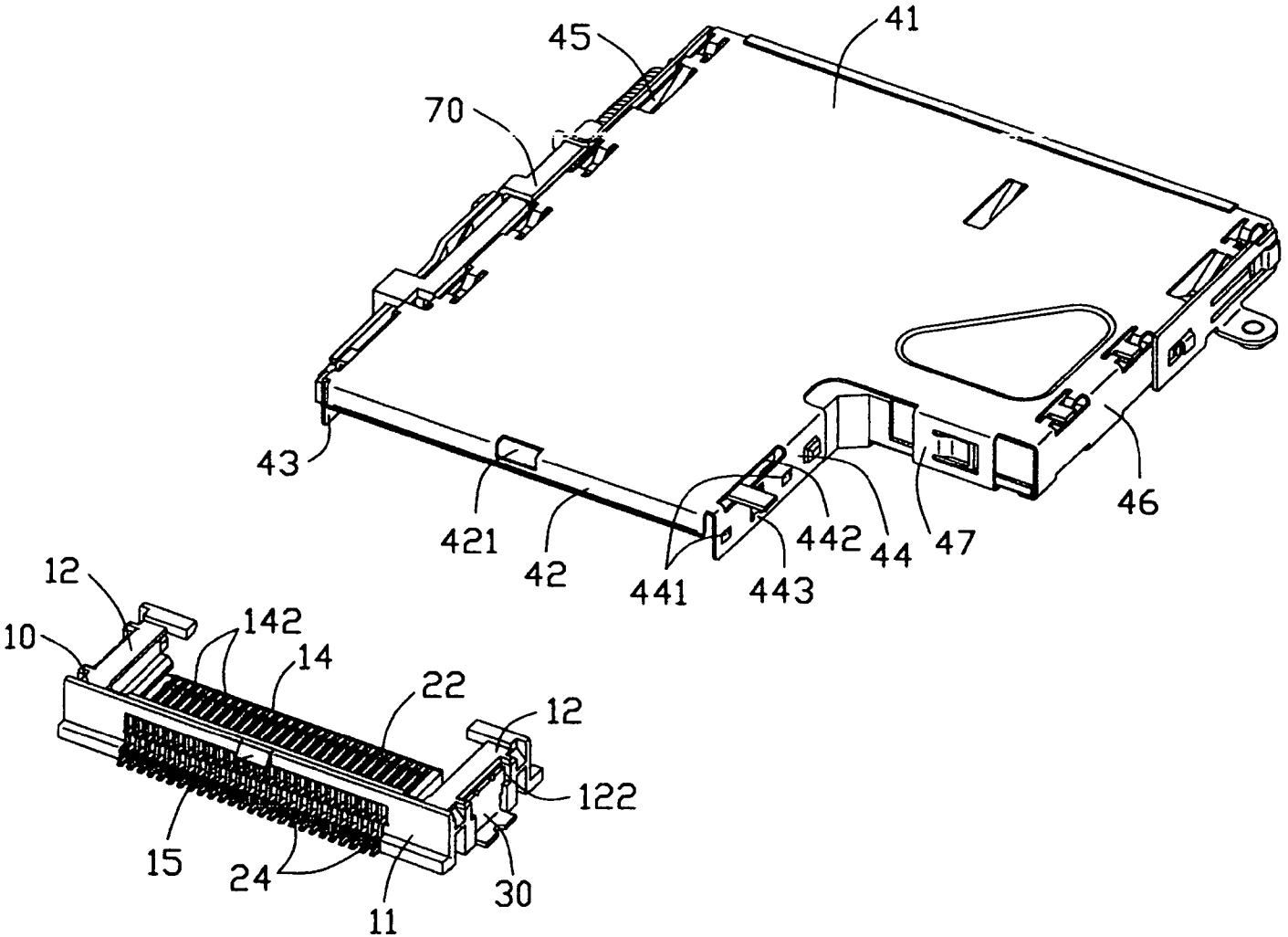
FIG. 2 is a perspective view of the electrical card connector shown in FIG. 1, wherein the shielding is not assembled.

Referring to FIG. 1 and FIG. 2, an electrical card connector 1 in accordance with the present invention comprises an elongated dielectric housing 10 having a plurality of connector terminals 20, a pair of soldering pieces 30 received in the dielectric housing 10, a shielding 40, a guide element 50, a pair of stand off devices 60 and an ejector 70.

Figure 3:
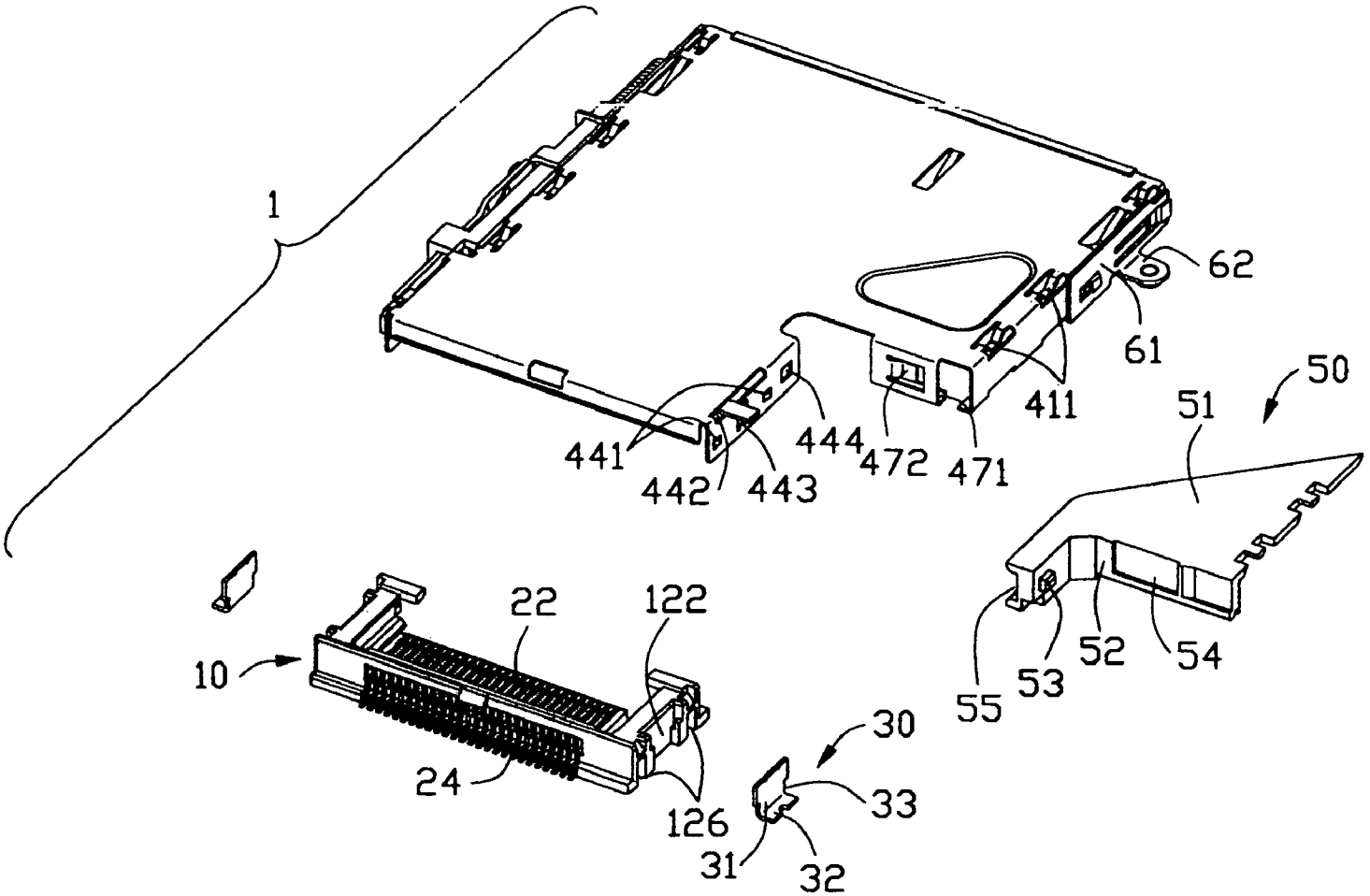
FIG. 3 is an exploded, perspective view of the card electrical connector shown in FIG. 2.

Referring to FIG. 2 and FIG. 3, the elongated dielectric housing 10 defining a card insertion/ejection direction has a base 11, a pair of guide racks 12 extending backwardly from opposite ends of the base 11 and a mating portion 14 extending from a central section of the base 11 and disposed between the two guide racks 12. The base 11 is formed with a block 15 at the front sidewall thereof for engaging with the shielding 40. Each guide rack 12 defines a slot 122 extending downwardly from the upper surface thereof and opening in a side face thereof. Each guide rack 12 further defines a plurality of latch holes 126 besides the slot 122. The mating portion 14 is formed with a plurality of parallel channels 142 for receiving the connector terminals 20. Each connector terminals 20 has a contact portion 22 for electrical connecting with an electrical card, a tail 24 for electrically connecting with a printed circuit board and a fixing portion (not shown) disposed between the contact portion 22 and the tail 24 and fixed in the channels 142 of the dielectric housing 10.

The soldering pieces 30 are inserted into the slots 122 of the guide rack 12, respectively, and each of the soldering pieces 30 has a vertical wall 31 retained in the slot 122 with a plurality of stabs 33 formed on the side edge thereof interferentially engaging with an inner surface of the slot 122 and a leg 32 extending from the vertical wall 31 and protruding out of the dielectric housing 10 to fixing on a grounding pad of the printed circuit board. Since the slot 122 opens in the side face of the guide rack 12, a part of the vertical wall 31 is exposed.

Referring to FIGS. 2–5, the shielding 40 is formed and stamped a metallic sheet. The shielding has a main body 41 in an "L" type shape and a plurality of sidewalls extending downwardly from edges of the main body 41 to form a receptacle space for accommodating the electrical card cooperating with the main body 41. These sidewalls comprise a front wall 42 extending from a front edge of the main body 41, a first and a second sidewalls 43, 44 at opposite sides of the front wall 42, a third sidewall 45 disposed in the same side with the first sidewall 43, a fourth sidewall 46 disposed in the same side with the second sidewall 44 and a longitudinal sidewall 47. The first and the second sidewalls 43,44 are respectively adjacent to opposite ends of the front wall 42, the third and the fourth sidewalls 45,46 are respectively parallel to the first and the second sidewalls 43, 44, and the longitudinal sidewall 47 is disposed between the second sidewalls 44 and the fourth sidewall 46.

When the shielding 40 is assembled on the dielectric housing 10, the main body 41 covers an upper surface of the dielectric housing 10, the front sidewall 42 shields the front face of the dielectric housing 10 and defines a gap 421 to engage with the block 15 of the dielectric housing 10, and the first and the second sidewalls 43, 44 respectively cover the side face of the guide rack 12. The first sidewall 43 is formed with a plurality of latches 431 extending into corresponding latch holes 126 to fix the shielding 40 to the dielectric housing 10. The first sidewall 43 defines a cut 432 for the ejecting rod 75 of the ejector 70 passing there through. Further more the first sidewall 43 is formed with an elastic piece 433 extending inwardly to electrically abut against the corresponding soldering piece 30 received in the slot 122. The second sidewall 44 has a same configuration with the first sidewall 43, and has a plurality of latches 441, a cut 442 and an elastic piece 443 abutting against the corresponding soldering piece 30.

Horizontal plates 451,461 extends inwardly from hemlines of the third and the fourth sidewall 45,46, respectively. Guide grooves 452,453 are defined between the horizontal plates 451,461 and the main body 41 for guiding and holding the insertion/ejection of the electrical car. The horizontal plates 451,461 are formed with a plurality of extrusive slices 453,463 along the inserting direction of the electrical card, and the main body 41 is formed with a plurality of depressed slices 411 above the corresponding slices 453,463. The electrical card will not swash in an up and down direction in the receptacle space of the shielding 40 due to being resiliently sandwiched by these oppositely disposed slices 411,453,463. The longitudinal sidewall 47 is bended backwardly from a hemline thereof to form a receive portion 471 for the guide element 50 with a spring arm 472 extending to the receive portion 471.

Figure 4:
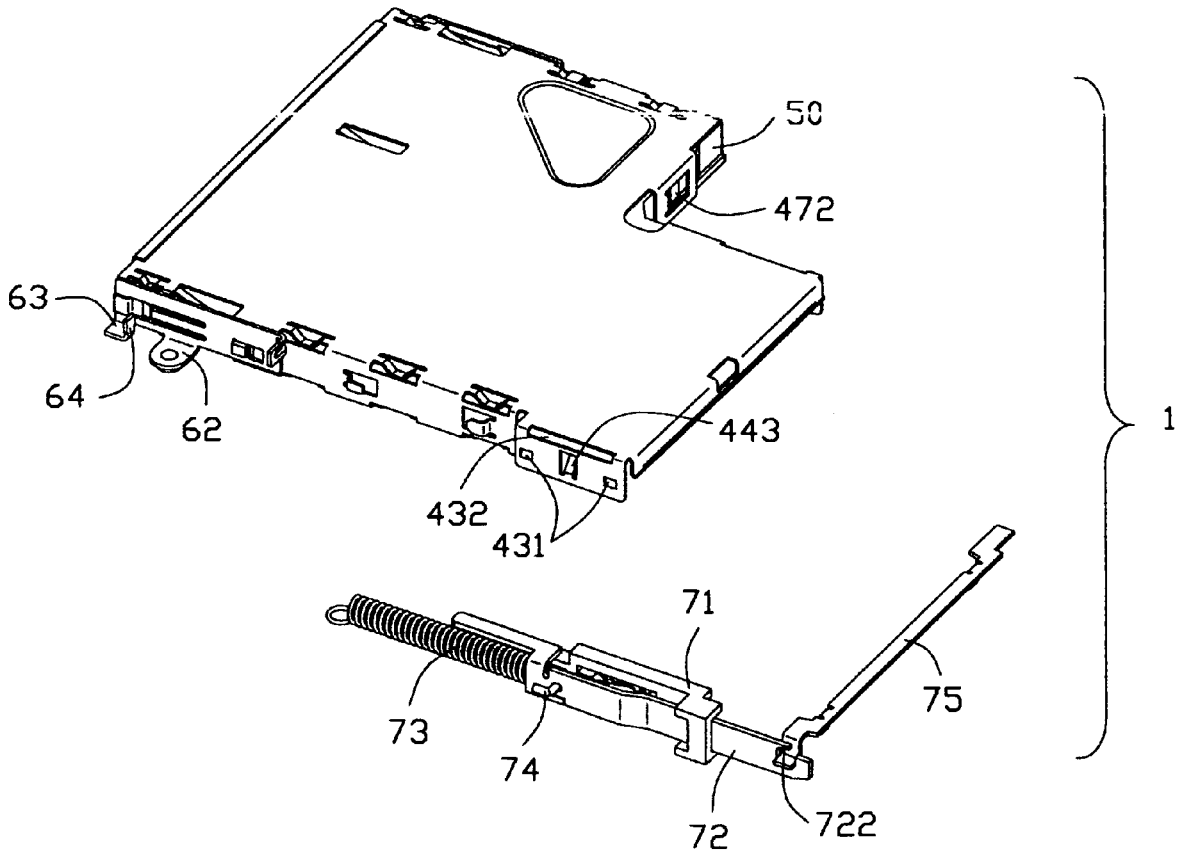
FIG. 4 is an exploded, perspective view of the shielding and an ejector of the card electrical connector shown in FIG. 2, taken from another angle.

Referring to FIGS. 2–4, the guider element 50 is approximately in a triangle shape, and has a board 51 and a "L" shape perpendicular wall 52 extending forwards and downwardly from the front of the board 51. The board 51 is received in the receive portion 471 of the longitudinal sidewall 47 and abuts against the fourth sidewall 46, the perpendicular wall 52 abuts against the second sidewall 44 of the shielding plate 40. The perpendicular wall 52 is formed with a projection 53 and a depressed portion 54 on an out surface thereof, the spring arm 472 of the longitudinal sidewall 47 is abutting against an inner sidewall of the depressed portion 54, and the second sidewall 44 of the shielding plate 40 is formed with a fixing hole 444 engaging with the projection 53 of the guider element 50. The perpendicular wall 52 is defined a guide channel 55 extending from the front portion of the perpendicular wall 52 for guiding the electrical card inserting into or ejecting out of the electrical card connector 1.

Each of the stand off device 60 has a flake 61 assembling on the shielding 40 and an engaging portion 62 soldered to a grounding pad of the printed board circuit. Further more the stand off device 60 in the same side with the ejector 70 is provided with an extrusive plate 63 with a tab 64 extending upwardly (referring to FIG. 4).

Figure 5:
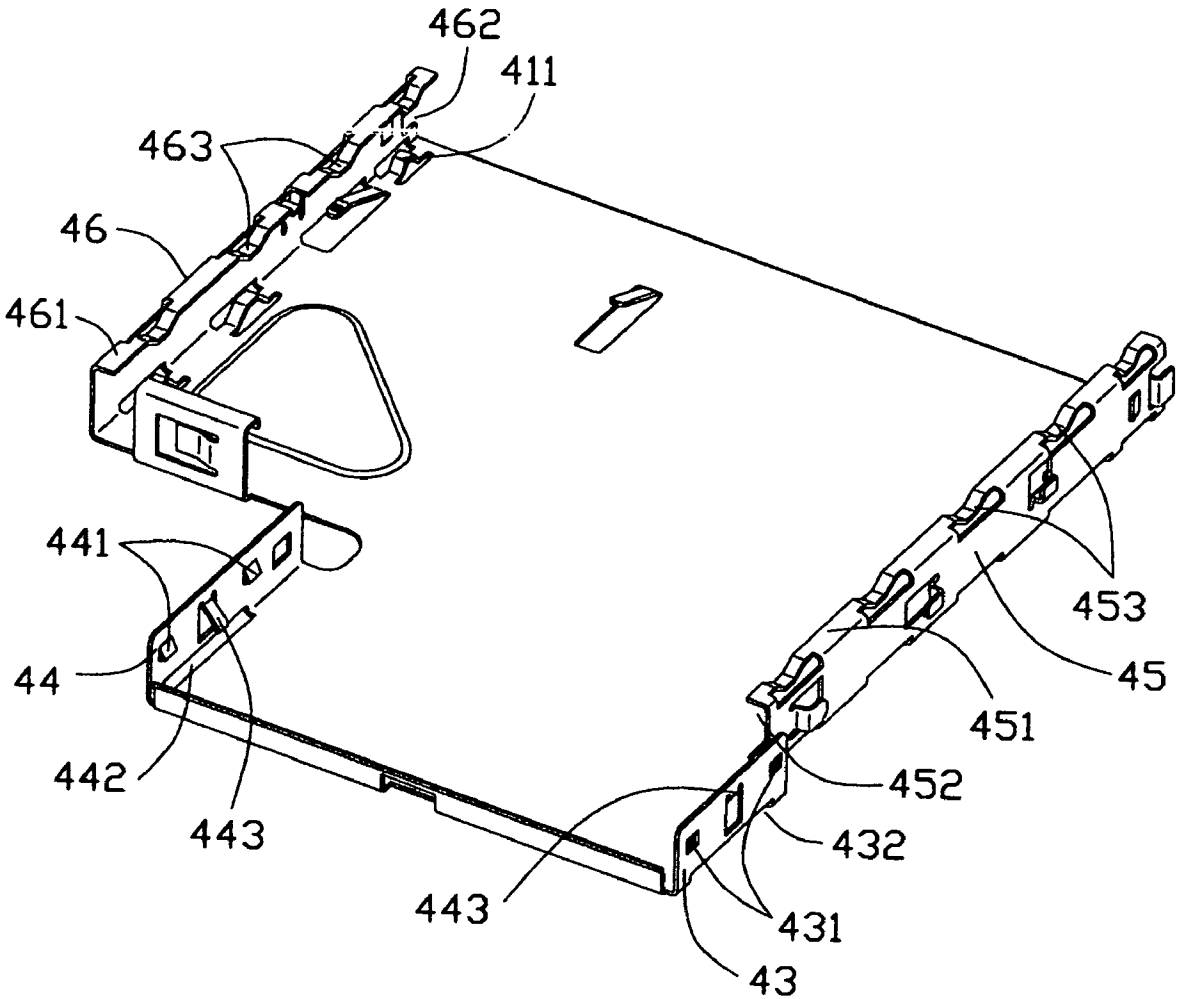
FIG. 5 is an bottom, perspective view of the shielding of the card electrical connector shown in FIG. 1.

Referring to FIG. 4 and FIG. 5, the ejector 70 is attached to the third sidewall 45 of the shielding plate 40 and comprises a holder member 71 having a heart groove, a push rod 72, a spring 73, a link pin 74 and an ejecting rod 75. The push rod 72 is slideaby assembled on the holder member 71 with a limit hole 722 defined at an end thereof. The spring 73 has a two ends, one end is fasten to the tab 64 of the stand off 60 assembled on the shielding 40, and the other clasps to the push rod 72 to drive the push rod 72 to slide toward an original position of the push rod 72. The link pin 74 connects with the push rod 72 and may slide in the heart groove of the holder member 71. The ejecting rod 75 is sandwiched in between the dielectric housing 10 and the shielding 40 by passing through the cuts 432, 442 of the shielding 40 and rotataly connecting with the push rod 72 via the limit hole 722.

The ejector 70 is a push-push type, during inserting the electrical card into the electrical card connector 100, a front face of the electrical card push the ejecting rod 75 to rotate, so that the push rod 72 is brought to move rearward along with the ejecting rod 75 and the link pin 74 slides in the heart groove. In this state, the spring 73 is deformed until the link pin 74 into a lock position of the heart groove, whereby the electrical card is fully inserted into the electrical card connector 1 and electrical connects with the contactor terminal 20. Pushing the electrical card forward again, the link pin 74 is released from the lock position, then the push rod 72 move forward driven by the resilience force of the spring 73 to bring the ejecting rod 75 to eject the electrical card out of the electrical card connector 1.

When the assembled electrical card connector 1 is mounting on the printed circuit board, the pair of soldering pieces 30 are soldered to the grounding pad on the printed circuit board to mount the dielectric housing 10 on the printed circuit board. Since the elastic pieces 433,443 of the shielding 40 abut against corresponding soldering pieces 30, so the grounding path of the shielding 40 is established by the soldering piece 30 and is closed to transfers interface to make the electrical card connector 1 get a good anti-EMI effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector for receiving a card comprising:

a dielectric housing defining a card insertion/ejection direction;

a plurality of connector terminals retained in the dielectric housing and comprising a plurality of contacting portions;

a shielding covering the dielectric housing and defining a card receiving space together with the dielectric housing; and an ejector comprising a push rod moving along the card insertion/ejection direction, an ejecting rod connecting with the push rod and exposed into the card receiving space for ejecting the card, a holder member retained to an outside of the shielding, a link pin and a resilient member for urging the push rod to move along the card ejection direction, the holder member formed with a heart groove, which cooperates with the link pin to securely lock the push rod and the card in a lock position during an insertion of the card and to release the push rod from the lock position by pushing the card in the lock position along the insertion direction.

2. The card connector as claimed in claim 1, wherein the push rod is configured to be synchronically moved along the same direction with the card.

3. The card connector as claimed in claim 1, wherein the ejecting rod is pushed by the card during an insertion of the card, and brings the push rod move along the card insertion/ejection direction and the link pin slides along the heart groove to lock the card and the push rod in the lock position; the locking is canceled by pushing the card again, then the resilient member forces the push rod and the link pin move to an original position, and the ejecting rod is driven by the push rod to eject the card.

4. The card connector as claimed in claim 3, wherein the push rod is slidably assembled to an outside of the holder member.

5. The card connector as claimed in claim 4, further comprising a stand off assembled on a sidewall of the shielding, the resilient member is a spring, one end of the spring is fasten to an end of the push rod away from the ejecting rod, and the other end is fasten to the stand off.

6. The card connector as claimed in claim 4, wherein the ejecting rod is detachably connecting with the push rod.

7. The card connector as claimed in claim 6, wherein the push rod defines a limit hole at an end thereof, the ejecting rod connects with the push rod via the limit hole.

8. A card connector for a card comprising:

a dielectric housing defining a card insertion and ejection directions;

a plurality of connector terminals retained in the dielectric housing and comprising a plurality of contacting portions;

a shielding covering the dielectric housing and defining a card receiving space together with the dielectric housing; and an ejector comprising a push rod moving along the card insertion or ejection direction with the inserted or ejected card and assembled to outside of the shielding, an ejecting rod disposed on the push rod and exposed into the card receiving space to eject the card, a holder member to securely hold the push rod and associated ejecting rod in a lock position where the card is electrically connected with the contacting portions of the connector terminals and to release the push rod and associated ejecting rod from the lock position when pushing the card, and a resilient member for urging the push rod to move along the card ejection direction; wherein the push rod and the associated ejecting rod are essentially moved along the same card insertion or ejection direction with inserted or ejected card.

9. The card connector as claimed in claim 8, wherein the holder member comprising formed with a heart groove and a link pin, is assembled to a sidewall of the shielding.

10. The card connector as claimed in claim 8, further comprising a standing portion disposed on the same side with the push rod, and one end of the resilient member is retained to the standing portion.

11. The card connector as claimed in claim 8, wherein the ejecting rod is discrete from and loosely engaged with the push rod.

12. The card connector as claimed in claim 8, wherein said shielding defines a sidewall beside which the push rod extends, and wherein said side wall defines a cut through which the ejecting rod extends.

13. The card connector as claimed in claim 8, wherein said ejecting rod extends laterally with a distance which is essentially similar to a transverse dimension of the card which is adapted to be received in the card receiving space.

14. The card connector as claimed in claim 8, wherein a distal end of the ejecting rod opposite to the push rod, is supported.

15. The card connector as claimed in claim 14, wherein said distal end of the ejecting rod is supportably moveable along a slot.

16. A card connector for a card comprising:

a dielectric housing defining a card mating direction;

a plurality of connector terminals retained in the dielectric housing and comprising a plurality of contacting portions;

a metallic shielding covering the dielectric housing and defining a card receiving space together with the dielectric housing;

a push rod located by one side of the card receiving space and moveable along said card mating direction;

an ejecting rod defining one end section engaged with a rear end section of the push rod so as to assure that the ejecting rod moves along the same direction with the push rod when pushed by the card; and a link pin being moveable in a heart groove, one of said pin and said heart groove being immoveable with the push rod so as to determine locking and unlocking positions of said push rod; wherein said push rod is located outside of the metallic shielding, and the heart groove cooperates with the link pin to securely lock the push rod and the card in a lock position during insertion of the card, and to release the push rod from the lock position by pushing the card in the lock position along the card mating direction.

17. The card connector as claimed in claim 16, wherein said ejecting rod extends laterally with a distance which is essentially similar to a transverse dimension of an electronic card which is adapted to be received in the card receiving space.

18. The card connector as claimed in claim 16, Wherein said shielding defines a sidewall beside which the push rod extends along said card meting direction, and said sidewall defines a cut through which the ejecting rod extends.

19. The card connector as claimed in claim 16 wherein the ejecting rod defining one end section is loosely engaged with a rear end section of the push rod so as to allowing somewhat rotation of said ejecting rod with regard to the push rod.

20. The card connector as claimed in claim 16, wherein a distal end of the ejecting rod opposite to the push rod, is supported.

* * * * *